United States Patent [19]

Furutsu

[11] Patent Number: 4,535,926

[45] Date of Patent: Aug. 20, 1985

[54] FASTENER DISPENSING DEVICE

[75] Inventor: Akira Furutsu, Tokyo, Japan

[73] Assignees: Japan Bano'k Co., Ltd., Tokyo, Japan; Ben Clements & Sons, Inc., South Hackensack, N.J.

[21] Appl. No.: 556,752

[22] Filed: Nov. 30, 1983

[51] Int. Cl.[3] ..... B25C 1/00

[52] U.S. Cl. ..... 227/67; 227/145

[58] Field of Search ..... 227/DIG. 1, 49, 67, 227/156, 145

[56] References Cited

U.S. PATENT DOCUMENTS 2,707,783 5/1955 Sullivan ..... 227/DIG. 1

3,924,788 12/1975 Furutu ..... 227/67

4,410,125 10/1983 Noiles et al. ..... 227/DIG. 1

*Primary Examiner*—Paul A. Bell

*Attorney, Agent, or Firm*—Blum Kaplan Friedman Silberman & Beran

[57] ABSTRACT

An improved fastener dispensing device which comprises a pistol-shaped main body mounted with a side-slitted hollow needle and comprising a grip part and a fastener driving part including a driver, and an operation lever which may be operated to drive the driver into the needle to drive the crossbar of a fastener to be dispensed into and through the needle, improved in that the driver at least partly comprises a flexible resilient structure.

6 Claims, 15 Drawing Figures

FASTENER DISPENSING DEVICE

BACKGROUND OF THE INVENTION

The present invention relates to a fastener dispensing device and, more particularly, to an improved device for dispensing fasteners of the type which are widely utilized in attaching tags or the like to various consumer goods or for fastening two or more articles together to form a unitary arrangement.

Fasteners as referred to herein mean such devices which are often called tagging pins and which individually include a filament having a head at one end of the filament and a crossbar formed at the other end thereof. The tag pins are manufactured from a synthetic resin, for example nylon or polypropylene, in the form of an integrally molded assembly, which generally consists of 20 to 50 individual fasteners which are connected through their respective connecting necks to a common connecting rod in an overall arrangment generally resembling a comb. For reasons having to do with the fabrication of molds for the manufacture of fastener assemblies and also the operation for dispensing fasteners by a dispensing device, individual fasteners are formed at certain spaced intervals on the common connecting rod.

Such fasteners are loaded assembly by assembly in a dispensing device and applied one at a time to articles such as fabric or other made-up goods by passing the respective crossbar through the articles. The fastener dispensing device itself includes a main body in the shape of a pistol and is often referred to as a tagging gun. In a front end or nose portion of the pistol-type main body, the device has a hollow needle which is slitted along a side thereof. In applying the fastener to an article, the needle is pierced into the article and an operation lever mounted in a front portion of the main body may then be gripped into the main body, whereby a pushing rod or driver such as a piston is operated to push the crossbar of a fastener through the needle and eventually through the article. When the needle is then pulled out of the article, the crossbar now has been pushed through the article and automatically returns to its original position perpendicular to the filament of the fastener, whereby the crossbar functions to anchor the dispensed fastener to the article and whereby a tag or the like is attached to the article. In addition, the fastening of a plurality of goods in a unitary arrangement can be accomplished in this manner.

As indicated above, the operation lever is mounted on the pistol-type main body in a manner capable of entering and coming out of the main body, and by gripping and releasing this lever, the driver is reciprocated in forward and backward directions, within the hollow needle.

In conventional fastener dispensing devices or guns, the driver is made of steel rod or soft rod, and with these conventional guns which make use of such a rigid driver, some difficulties are encountered. For example, if the article into which the needle is pierced is hard or if the needle is applied at a relatively great velocity of penetration, the needle may bend as described below.

When the article is so hard that the needle cannot with ease be applied into or through the article, a first problem occurs such that as a result of an attempt to forcibly apply the needle into the article, the needle may be caused to bend. If the hollow needle is bent when the driver is inserted in the needle, the driver cannot be pulled out of the needle. It then not only becomes necessary to replace the bent needle and driver and/or various driving parts for the driver but it is also likely that damage to the article will occur.

A second problem is concerned with the fact that conventional hollow needles are straight. Sometimes, needles have to be applied at other than a right angle to the article and it proves difficult to apply the needle at such inclinations.

A further difficulty with conventional tagging guns concerns a recently growing demand that the conventional guns should be made capable of an applied use for putting together two or more sheet-like products in a sewing manner. In this case, it is indispensably required to apply the needle at an inclination to sheet-like materials, but as pointed out above, it is difficult to carry out such sewing operation with conventional tagging guns.

SUMMARY OF THE INVENTION

Accordingly, the object of the present invention is to remedy the problems associated with conventional fastener dispensing devices such that when the hollow needle is bent, the driver cannot be pulled out and that it is difficult to use a curved hollow needle in the device due to the rigid driver.

To attain the above object, the present invention provides a fastener dispensing device comprising a main body, an operation lever rockably coupled to a grip part of the main body, a driver driven to reciprocate by operating the operation lever and a side-slitted hollow needle mounted on a front end portion of the main body in the direction of the reciprocal motion of the driver, characterized or improved in that the driver is made of a flexible resilient material or made having a thickness reduced portion capable of coming out of the needle through the side slit of the needle.

The above and other objects, characteristics and advantages of the present invention will become apparent from considering the following detailed description of the present invention, taken in conjunction with the accompanying drawings.

DESCRIPTION OF THE PREFERRED EMBODIMENTS

To facilitate understanding of the present invention, a brief description will be presented first in connection with the general structure of a fastener dispensing device or gun.

Figure 1:
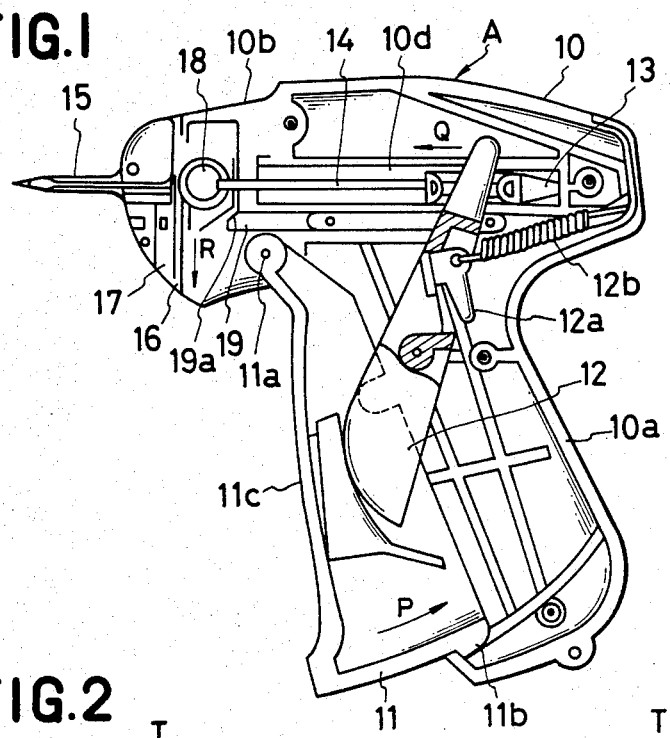
FIG. 1 is a side elevational view showing general structural features of a fastener dispensing device.

As shown in FIG. 1, the gun generally indicated at A comprises a main body 10 generally resembling a pistol, which partly comprises a grip part 10*a*, on which an operation lever or trigger 11 is rockably mounted through a pin or shaft 11*a*. The lever 11 is normally kept in a condition or position of being projected from the grip part 10*a* by a pressing action of an intermediate lever 12 actuated by a spring 12*b* and stopped at a wall portion of the grip part 10*a* with its stopper part 11*b* formed at a lower end portion thereof. That is to say, the trigger 11 is normally kept in the position shown in FIG. 1.

Then, when trigger 11 is pulled-in by gripping at a fingering part 11*c* thereof, the trigger 11 rotates or rocks in the direction of an arrow P with the shaft 11*a* as the axis of rotation to cause the intermediate lever 12 to similarly rock, while expanding the spring 12*b* and downwardly moving a slider 12*a*, whereby a slider 13 is rapidly driven in the direction of an arrow Q, the slider 13 being slidably received in a guide groove 10*d* in a fastener shooting part 10*b* (FIG. 13) of the gun A. As a result of the high-speed sliding motion of the slider 13, the front or forward end of a driver such as a piston or pushing rod 14 fixed to the slider 13 is pushed into a side-slitted hollow needle 15 with a great force.

In a portion of the fastener shooting part 10*b* behind the needle mounting portion, the fastener dispensing device A is provided with another guide groove 16 extending in a direction crossing the path of reciprocation of the driver 14. A tag-pin assembly, namely a fastener assembly T (FIGS. 2 and 3), is loaded in the device A, from the top end of this guide groove 16.

In the fastener shooting part 10*b*, further, a sliding bar 19 is disposed, which, when the above-mentioned slider 13 is driven by rotation of the intermediate lever 12, is driven to slide in synchronism. At each gripping and releasing operation of the trigger 11, bar 19 undergoes a forward and a backward motion to cause, with a cam surface 19*a* formed at a front end portion thereof, a fastener feeding member 18 comprising for example a gear and disposed in a guide groove at a side of the groove 16, to rotate a tooth-pitch distance each time so that the connecting rod of a fastener assembly loaded in the guide groove 16 can be fed in the direction shown by an arrow R, each time the distance corresponding to the interfastener pitch on the connecting rod, so as to bring the crossbar of respective fasteners to be located at the open rear end of the hollow needle 15.

Figure 2:
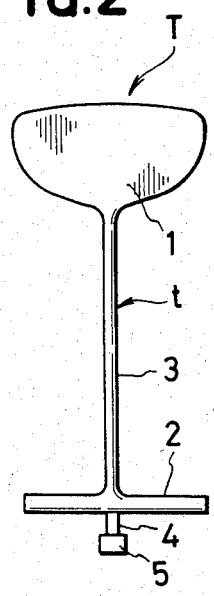
FIG. 2 shows a front elevation of a fastener assembly.
Figure 3:
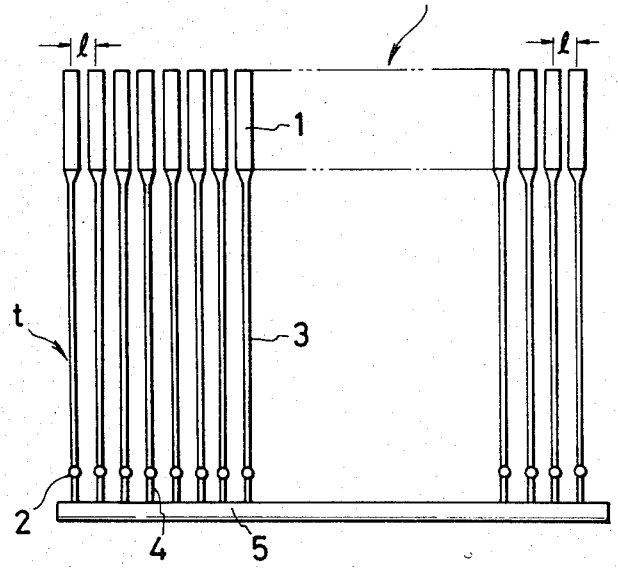
FIG. 3 is a side elevation of the fastener assembly of FIG. 1.

Now, reference is made to FIGS. 2 and 3, which in combination show fasteners or tag pins t, which individually comprise a head 1 for holding a price tag or the like to the article, a filament 3 and a crossbar 2 to be passed through the texture of an article, for example, clothing. Individual tag pins t are altogether connected through their respective connecting necks 4 to a common connecting rod 5 in an arrangement resembling a comb, and altogether are formed as a fastener or a tag-pin assembly T.

The fastener assembly T is produced in the form of a unitary body product by molding a synthetic resin which can increase in its strength when subjected to stretching, such as nylon and polypropylene, for example. As stated before, for purposes of high productivity and ease of handling, each fastener assembly T is formed as a whole as a comb-like product comprising 20 to 50 individual spaced fasteners arranged with and connected together on a single connecting rod 5. Further, for reasons concerned with the fabrication of molds, fasteners t are spaced on the connecting rod 5 at distances l, which normally are of the order of 2 mm.

As aforenoted, in the fastener dispensing gun A, fasteners of a loaded assembly T are successively fed in the direction of the arrow R in a manner such that connecting necks 4 of fasteners t are engaged by a fastener feeding member such as a gear 18, which is rotated, each time the distance corresponding to the inter-fastener pitch on the connecting rod 5. At the side of the fastener guide groove 16 closer to the hollow needle 15, a cutting blade 17 is disposed at the position corresponding to that at which the connecting necks 4 of fasteners are finally located as a result of feeding of the fastener assembly T within the guide groove 16. An arrangement is made such that when each fastener is about to be pushed into the hollow needle 15 with its crossbar 2 by the function of the driver 14, its connecting neck 4 can be cut by the cutting blade 17 and severed from the connecting rod.

Figure 4:
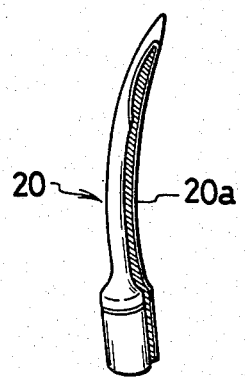
FIG. 4 shows in perspective a side-slitted hollow needle.

Now, turning to a detailed description of the preferred embodiments of the present invention, FIG. 4 shows a perspective view of a side-slitted hollow needle of a particular configuration to be mounted on the fastener dispensing gun, in accordance with the present invention. As shown, the hollow needle indicated at 20 has a structure gradually bent or curved in the direction of a side slit 20*a*. With this needle 20, it is advantageously made feasible to perform sewing of sheets or sheet-like objects. As in the case of sewing needles, the needle 20 can be pierced through for example a sheet to apply the filament 3 of a fastener t from one side to the other side and again to the same one side thereof so that the head 1 and crossbar 2 of the fastener t can be disposed on the same side of the sheet.

Since the needle 20 is curved as above, it is difficult or impossible with use of a conventional rigid driver to drive the crossbar 2 into and through the application needle 20. With a rigid driver, motion of the driver inside the needle 20 is stopped at an intermediate point in the length of the needle and cannot be furthered over the intermediate point.

The present invention provides an improved fastener dispensing device or gun incorporating such a driver which can be effectively utilized even if the gun has a curved fastener-shooting needle, and in order to provide a driver which can curve along the curved axis of the hollow needle 20, it is necessary to make the driver comprising a structure as flexible as possible.

Figure 5:
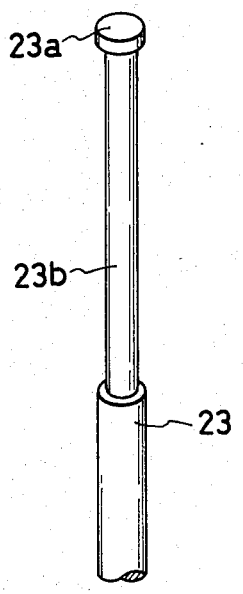
FIG. 5 is a perspective view of a driver representing a first embodiment of the present invention.

FIG. 5 shows in perspective an upper portion of a driver 23 according to a first embodiment of the invention, which is formed with a thickness reduced portion 23*b*, which has a reduced diametrical size in comparison to a top end portion 23*a* of the driver 23. The thickness reduced portion 23*b* is a portion to be inserted into the hollow needle 20 and should preferably extend only the smallest possible length so that the rigidity of the driver 23 may not be unduly reduced.

Figure 6:
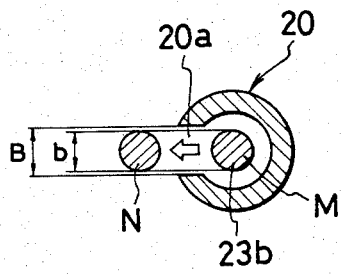
FIG. 6 is a sectional view, taken for illustration, of an operational condition of the driver of FIG. 5.

FIG. 6 shows a condition in use of the driver 23 of FIG. 5, and as shown, in the curved hollow needle 20 the thickness reduced portion 23*b* of the driver 23 is deviated from an original position M to a projected position N outside the needle. Thus, it will be seen that the smaller diametrical portion 23*b* of the driver 23 has a diameter b of a smaller size than the width B of the side slit 20*a* of the needle 20.

Figure 7:
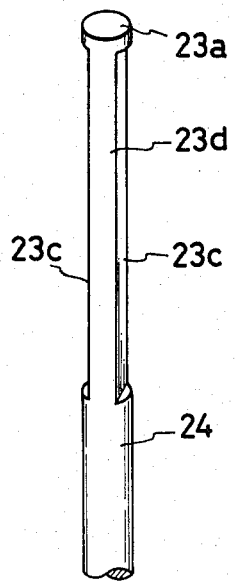
FIG. 7 shows a perspective view of a driver according to a second embodiment of the present invention.

Similar to FIG. 6, FIG. 7 shows a perspective view of an upper portion of a driver but of a second embodiment of the invention. The driver indicated at 24 of the present embodiment is chamfered along opposite sides so as to have flat faces 23*c* and thereby formed with a thickness reduced portion 23*d*, while its top end portion 23*a* has a full circular configuration.

Figure 8:
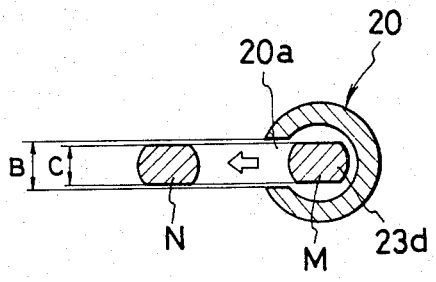
FIG. 8 is a sectional view similar to FIG. 6 and shows the driver of FIG. 7 in operation.

As illustrated in FIG. 8, in the case of the above driver 24 of FIG. 7 the thickness reduced portion 23*d* of a width c is protruded laterally out of the slide slit 20*a* of the width B of the needle.

It will be perceived that in the cases of drivers 23 and 24 illustated in FIGS. 5 through 8, the reduced diametrical portion 23*b* and the thickness reduced portion 23*d* can come out of the side slit 20*a* of the hollow needle 20 and can be deviated from the position M to the position N so that in case the slide-slit hollow needle 20 undergoes a bending, the drivers 23 and 24 can be effectively prevented from becoming broken.

Figure 9:
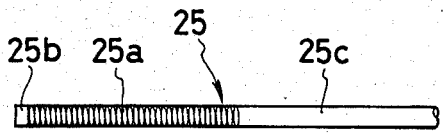
FIG. 9 shows a side elevational view of a driver according to a third embodiment of the present invention.

FIG. 9 shows a partial front view of a driver 25 according to a third embodiment of the invention. This driver 25 is structured in its front end portion by a coiled spring 25*a* and has at its front end a fastener abutting portion 25*b*. The base portion of the driver 25, shown at 25*c*, is made of a normally employed rigid steel.

Figure 10:
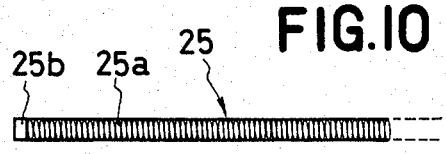
FIG. 10 similarly shows a side elevation of a driver according to a fourth embodiment of the invention.

FIG. 10 represents a fourth embodiment of the invention, and the driver 25 of this embodiment is wholly structured by a coiled spring 25*a* and is more rich in the flexibility than the driver 25 of FIG. 9.

Figure 11:
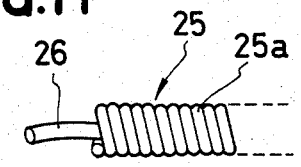
FIG. 11 is a partial view, taken for illustration, of the structure of a driver according to a fifth embodiment of the invention.
Figure 12:
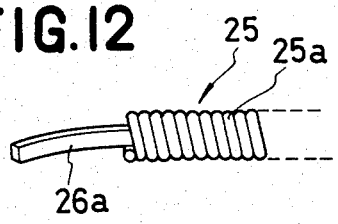
FIG. 12 is a similar partial view to FIG. 11 and represents a sixth embodiment of the invention.

When the driver 25 is wholly structured by a coiled spring as in the above example of FIG. 10, the structure thereof may possibly be too poor in rigidity to answer practical use of the driver. Therefore, in the fifth embodiment shown in FIG. 11, it is devised to incorporate a piano wire 26 as a core member and apply a coiled spring 25*a* about such core member, or in the instance of the driver 25 shown in FIG. 12 representing a sixth embodiment of the invention, the spring 25*a* is applied about such a reinforcing core member as comprising a strip of a steel plate 26*a*.

Figure 13:
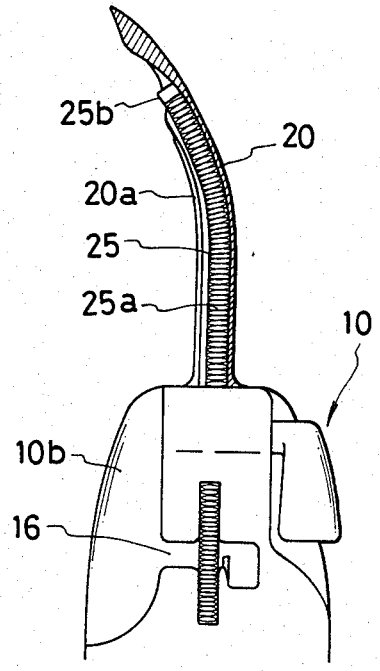
FIG. 13 shows partly in setion a front end portion of a fastener dispensing device, taken for illustration, of a condition in operation of the driver shown in FIGS. 9 and 10.

FIG. 13 shows the nose end portion of the main body 10 of a fastener dispensing gun, which is mounted in the fastener shooting part 10*b* with a laterally curved side-slitted hollow needle 20, into which the driver 25 shown in FIG. 10 is inserted. The driver 25 having a high flexibility, it can with ease enter into or come out of the curved needle as shown and can operatively effectively guide the crossbar 2 of a tag pin or fastener t through the needle 20.

Figure 14:
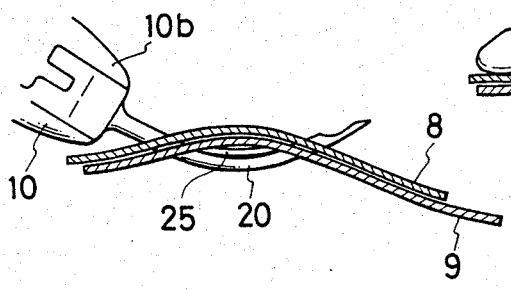
FIGS. 14 and 15 are views, showing the manner in which a fastener is dispensed by use of a fastener dispensing device according to the present invention.
Figure 15:
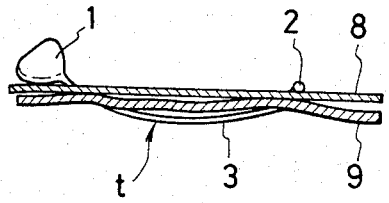

In sewing, for example, two sheets together with use of a fastener t, a curved hollow needle 20 may be mounted on the main body 10 of the gun A as shown in FIG. 14, and use may be made of one of the drivers shown in FIGS. 9 to 12. In greater detail, the curved hollow needle 20 may be applied through piled or overlaid first sheet 8 and second sheet 9, for example from the side of the first sheet 8 to that of the second sheet 9 and then to the side of the first sheet 8 as shown in FIG. 14, and thereafter the operation lever or trigger 11 may be operated, whereby upon pulling the needle 20 out of the sheets 8 and 9 the latter can be sewn together with a fastener t as illustrated in FIG. 15.

As shown in FIGS. 9 to 12, use is made of a coiled spring 25*a* to provide drivers 25 of a flexible structure. Alternatively, use may be effectively made of any other material insofar as it has a flexibility, such as glass fibers, carbon fibers and filamentary steel wires which may be employed in the form of a bundle.

As described in detail above, with the fastener dispensing gun according to the present invention at least a part of the driver to be inserted into the side-slitted hollow needle is so structured as to undergo bending or flexing relatively with ease, and attributable to this, the invention can bring about the following advantages:

a. A front end portion of the driver can with ease enter into or come out of a fastener-shooting hollow needle even if the needle is of a curved structure, so that fasteners can be dispensed in a manner of sewing sheets or sheet-like matters, which cannot be operated or which at least is difficult with conventional comparable guns.

b. Even in the case where a conventional hollow needle of a straight linear structure is caused to bend during fastener dispensing operation, the driver can with ease be removed out of the bent needle, whereby it is feasible to prevent the driver and/or other parts or element for driving the driver from accidentally becoming damaged or it at least is possible to minimize the number of parts or elements likely to become damaged.

c. The driver does not undergo breakage, so that the fastener dispensing device can be applied to use in an automatic tagging machine.

What is claimed is:

1. A fastener dispensing device for applying individual tag pins from an assembly, each tag pin having a head section and a crossbar joined together by a filament, comprising a main body having a grip portion and a nose portion, an operation lever pivotably supported on said grip portion of said main body, a side-slitted hollow needle supported on said nose portion of said main body, said hollow needle being curved such that said side-slitted portion of said hollow needle lies along the inside surface of said curve, and a driver supported in said main body operatively coupled to said operation lever and adapted to reciprocate through said hollow needle as said operation lever is squeezed and released, said driver having a top end portion which abuts against successive crossbars of said tag pins in said assembly to push said crossbars through said hollow needle as said driver is reciprocated, said driver including a flexible stem portion at least along a portion of its length to permit said top end portion of said driver to travel in said curved hollow needle to press successive crossbars therethrough.

2. The fastener dispensing device as claimed in claim 1, wherein said flexible stem portion is formed from a coiled spring.

3. The fastener dispensing device as claimed in claim 1, wherein said flexible stem portion includes a flexible core member and a coiled spring coiled around said flexible core member.

4. The fastener dispensing device as claimed in claim 3, wherein said flexible core member is piano wire.

5. The fastener dispensing device as claimed in claim 1, wherein said driver is formed from a bundled fiber material selected from the group consisting of glass fiber and carbon fiber.

6. The fastener dispenser device as claimed in claim 1, wherein said flexible stem portion has a thickness which is smaller than the width of said side-slit of said curved hollow needle.

* * * * *